US008995605B2

(12) United States Patent
Chang et al.

(10) Patent No.: US 8,995,605 B2
(45) Date of Patent: Mar. 31, 2015

(54) LID FRAME FOR NUCLEAR FUEL ASSEMBLY SHIPPING CONTAINER AND SHIPPING CONTAINER FOR NUCLEAR FUEL ASSEMBLIES

(75) Inventors: Hung Soon Chang, Daejeon (KR); Chang Hwan Hwang, Daejeon (KR); Deuk Yeon Kim, Daejeon (KR); Jae Soon Choi, Daejeon (KR); Weon Chan Hwang, Daejeon (KR); Se Yong Shin, Daejeon (KR); Young Hoon Kim, Daejeon (KR); Jong Sung Hong, Daejeon (KR)

(73) Assignee: Kepco Nuclear Fuel Co., Ltd., Daejeon (KR)

( * ) Notice: Subject to any disclaimer, the term of this patent is extended or adjusted under 35 U.S.C. 154(b) by 1078 days.

(21) Appl. No.: 12/979,308

(22) Filed: Dec. 27, 2010

(65) Prior Publication Data

US 2012/0008729 A1 Jan. 12, 2012

(30) Foreign Application Priority Data

Jul. 12, 2010 (KR) ..... 10-2010-0066765

(51) Int. Cl.

| | |
|---|---|
| ***G21C 19/06*** | (2006.01) |
| ***G21F 5/008*** | (2006.01) |
| ***G21F 5/12*** | (2006.01) |
| ***G21F 5/012*** | (2006.01) |
| ***G21F 5/06*** | (2006.01) |
| *G21C 19/00* | (2006.01) |
| *G21F 5/00* | (2006.01) |

(52) U.S. Cl.

CPC . *G21F 5/012* (2013.01); *G21F 5/06* (2013.01)
USPC ..... 376/272; 376/260; 220/200; 220/315; 220/324; 250/505.1; 250/506.1

(58) Field of Classification Search

USPC ..... 376/260, 272, 463; 34/523, 60; 198/463.1, 469.1, 470.1, 474.1, 476.1; 206/701, 706, 707; 248/127, 128, 133, 248/139, 141, 200, 205.2, 226.11, 231.71, 248/231.81, 231.85, 317, 323, 327; 220/4.01, 4.28, 4.33, 200, 315, 319, 220/320, 321, 324, 327, 328, 485; 250/505.1–519.1

See application file for complete search history.

(56) References Cited

U.S. PATENT DOCUMENTS

| | | | | |
|---|---|---|---|---|
| 3,734,439 | A * | 5/1973 | Wintz | 220/485 |
| 3,888,379 | A * | 6/1975 | Folberth | 220/4.28 |
| 4,317,551 | A * | 3/1982 | Bishop | 248/141 |

(Continued)

FOREIGN PATENT DOCUMENTS

JP 61-17699 U 2/1986

*Primary Examiner* — Bernarr Gregory
(74) *Attorney, Agent, or Firm* — Rabin & Berdo, P.C.

(57) ABSTRACT

A lid frame for a nuclear fuel assembly shipping container and a shipping container for nuclear fuel assemblies are provided. The shipping container can include a lower container in which a cradle is installed, an upper container detachably coupled to the lower container, and a base frame coupled to the cradle with at least one nuclear fuel assembly placed thereon. The lid frame can include a plurality of supports installed apart from each other so as to surround the nuclear fuel assembly placed on the base frame, and a plurality of clamps separated from each other, coupled to the plurality of supports perpendicular to the plurality of supports, rotatably hinged to the base frame, and configured to clamp the nuclear fuel assembly. The lid frame safely protects the nuclear fuel assembly that is being transported.

7 Claims, 6 Drawing Sheets

(56) References Cited

U.S. PATENT DOCUMENTS

| | | | | | |
|---|---|---|---|---|---|
| 4,418,820 | A | * | 12/1983 | Nagle et al. | 206/707 |
| 4,478,331 | A | * | 10/1984 | Ruin | 206/707 |
| 4,637,763 | A | * | 1/1987 | Van Iperen | 248/327 |
| 5,190,257 | A | * | 3/1993 | Gradei et al. | 248/231.71 |
| 5,263,063 | A | * | 11/1993 | Sappey | 376/272 |
| 5,263,064 | A | * | 11/1993 | Sappey | 376/272 |
| 5,481,117 | A | * | 1/1996 | Gilmore et al. | 376/272 |
| 5,515,405 | A | * | 5/1996 | Gilmore et al. | 376/272 |
| 5,542,576 | A | * | 8/1996 | Arment | 220/328 |
| 5,600,896 | A | * | 2/1997 | Lin | 34/60 |
| 5,607,045 | A | * | 3/1997 | Hermann Kronseder | 198/476.1 |
| 5,617,967 | A | * | 4/1997 | Neidhart | 220/4.33 |
| 5,743,377 | A | * | 4/1998 | Kronseder | 198/470.1 |
| 5,762,227 | A | * | 6/1998 | Mitchell | 220/321 |
| 6,581,264 | B2 | * | 6/2003 | Ohori et al. | 220/324 |
| 6,748,042 | B1 | * | 6/2004 | Stilwell et al. | 376/272 |
| 6,898,258 | B2 | * | 5/2005 | Ohsono et al. | 376/272 |
| 7,327,821 | B2 | * | 2/2008 | Ishihara et al. | 376/272 |
| 8,135,107 | B2 | * | 3/2012 | Singh et al. | 376/272 |
| 2009/0190711 | A1 | * | 7/2009 | Fantini | 376/272 |

* cited by examiner

LID FRAME FOR NUCLEAR FUEL ASSEMBLY SHIPPING CONTAINER AND SHIPPING CONTAINER FOR NUCLEAR FUEL ASSEMBLIES

CROSS-REFERENCE TO RELATED APPLICATIONS

The present application claims priority under 35 U.S.C. 119 to Korean Patent Application No. 10-2010-0066765, filed on Jul. 12, 2010, the disclosure of which is expressly incorporated by reference herein in its entirety.

BACKGROUND OF THE INVENTION

1. Field of the Invention

The present invention relates to a lid frame for a nuclear fuel assembly shipping container and a shipping container for nuclear fuel assemblies, capable of safely transporting a nuclear fuel assembly to a nuclear power plant, etc. after the nuclear fuel assembly has been produced.

2. Description of the Related Art

In general, nuclear fuel such as enriched uranium or mixed oxide needs to be transported between various places, for instance a place where they are concentrated, a fuel rod producing place, and so on. For this transporting stage, the fuel is typically shaped like a small pellet.

When stored, this fuel requires a constant level of thermal insulation and structural strength to comply with international standards, and the control of their criticality is a main concern, and the mass of enriched fuel in a shipping container should be strictly restricted such that a dangerous situation does not arise. Due to this requirement, the volume of fuel that can be transported in a shipping container of a certain volume is under strict restrictions.

As a result, numerous shipping containers for transporting the nuclear fuel assembly have been disclosed. As shown in FIG. 1, such a shipping container is designed so that a plurality of clamps 10 are installed separately apart from each other by predetermined intervals so as to clamp a nuclear fuel assembly 1. In this case, it is impossible to safely protect the nuclear fuel assembly from external shocks caused by falling, penetration, and so on.

To compensate for this problem, as shown in FIG. 2, the shipping container may be designed so that a pair of clamping frames 20 are coupled to opposite long sides of the shipping container with the nuclear fuel assembly disposed therebetween, and are formed in a completely closed shape so that the nuclear fuel assembly is clamped. The strength of the shipping container itself including the clamping frames 20 must be reliable, and thus the containers are typically formed of a metal material. In this way, when the clamping frames 20 are formed in a completely closed shape, the nuclear fuel assembly can be safely protected, but the shipping container itself becomes very heavy, and the cost of production is increased as well.

Furthermore, in the case of conventional nuclear fuel assembly shipping containers with clamps that have the same size, since the positions of the spacer grids are different for each type of nuclear fuel assembly, a lid frame in which the clamps are disposed so as to correspond to the positions of the spacer grids should be used to transport different types of nuclear fuel assemblies. Accordingly, a different lid frame should be provided depending on the type of nuclear fuel assembly.

SUMMARY OF THE INVENTION

Accordingly, the present invention has been made keeping in mind the above problems occurring in the related art, and embodiments of the present invention provide a lid frame for a nuclear fuel assembly shipping container, which is designed to improve durability, stiffness, etc. so as to be able to sufficiently withstand unexpected accidents or external shocks, and to cover an entire nuclear fuel assembly, thereby making it possible to safely protect the nuclear fuel assembly and to reduce its weight, and a shipping container for nuclear fuel assemblies as well.

Embodiments of the present invention also provide a lid frame for a nuclear fuel assembly shipping container and a shipping container for nuclear fuel assemblies, which allow different types of nuclear fuel assemblies, between which the position of each spacer grid is different, to be transported using one type of lid frame.

According to an aspect of the present invention, there is provided a lid frame for a nuclear fuel assembly shipping container, in which the shipping container includes a lower container in which a cradle is installed, an upper container detachably coupled to the lower container, and a base frame coupled to the cradle with at least one nuclear fuel assembly placed thereon. The lid frame, comprises: a plurality of supports installed apart from each other so as to surround the nuclear fuel assembly placed on the base frame; and a plurality of clamps separated from each other, coupled to the plurality of supports so as to be perpendicular to the plurality of supports, rotatably hinged to the base frame, and clamping the nuclear fuel assembly.

According to another aspect of the present invention, there is provided a shipping container for nuclear fuel assemblies, which comprises: a lower container in which a cradle is installed; an upper container detachably coupled to the lower container; a base frame coupled to the cradle with at least one nuclear fuel assembly placed thereon; and a pair of lid frames installed on opposite long sides of the base frame in order to clamp the nuclear fuel assembly placed on the base frame. Each lid frame includes: a plurality of supports installed apart from each other so as to surround the nuclear fuel assembly placed on the base frame; and narrow and wide clamps separated from each other, coupled to the plurality of supports so as to be perpendicular to the plurality of supports, rotatably hinged to the base frame, and clamping the nuclear fuel assembly.

Here, the shipping container can further include buffers interposed between the lower container and the cradle in order to absorb shocks applied to the nuclear fuel assembly.

Further, the shipping container can further include: hinge couplers formed at one end of the cradle; hinge pieces formed on the base frame so as to correspond to the hinge couplers; and hinge bolts, each of which couples each of the hinge couplers and the hinge pieces.

Also, the shipping container can further include a support rod, which supports the nuclear fuel assembly when the nuclear fuel assembly stands erect at one end of the lower container.

In addition, the lid frame can further include press members installed on inner surfaces of the narrow and wide clamps in order to press spacer grids of the nuclear fuel assembly.

Each press member can include: a press plate that is interposed between each of the narrow and wide clamps and each spacer grid and pressing the spacer grid; and an adjustment screw that passes through each of the narrow and wide clamps to be coupled to the press plate.

The lid frame can further include: a first press plate holding recess formed inside the narrow clamp so as to hold the press plate; and second press plate holding recesses formed inside the wide clamp so as to hold the press plates. The second press plate holding recesses can hold the press plates so as to be able to press each spacer grid in different types of nuclear fuel assemblies between which the position of each spacer grid is different.

According to the present invention configured in this way, the lid frame installed in the shipping container to stably clamp the nuclear fuel assembly has a lattice shape, so that it is possible to improve stability of the nuclear fuel assembly compared to an existing method of clamping the nuclear fuel assembly only with clamps. Further, it is possible to remarkably reduce the weight compared to an existing clamping frame having a completely closed shape, so that the lid frame can be used at a nuclear power plant equipped with a nuclear fuel assembly handling crane having a relatively small capacity, and can also reduce the cost of production, which is advantageous from the economical point of view.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Reference will now be made in greater detail to exemplary embodiments of the invention with reference to the accompanying drawings.

Figure 3:
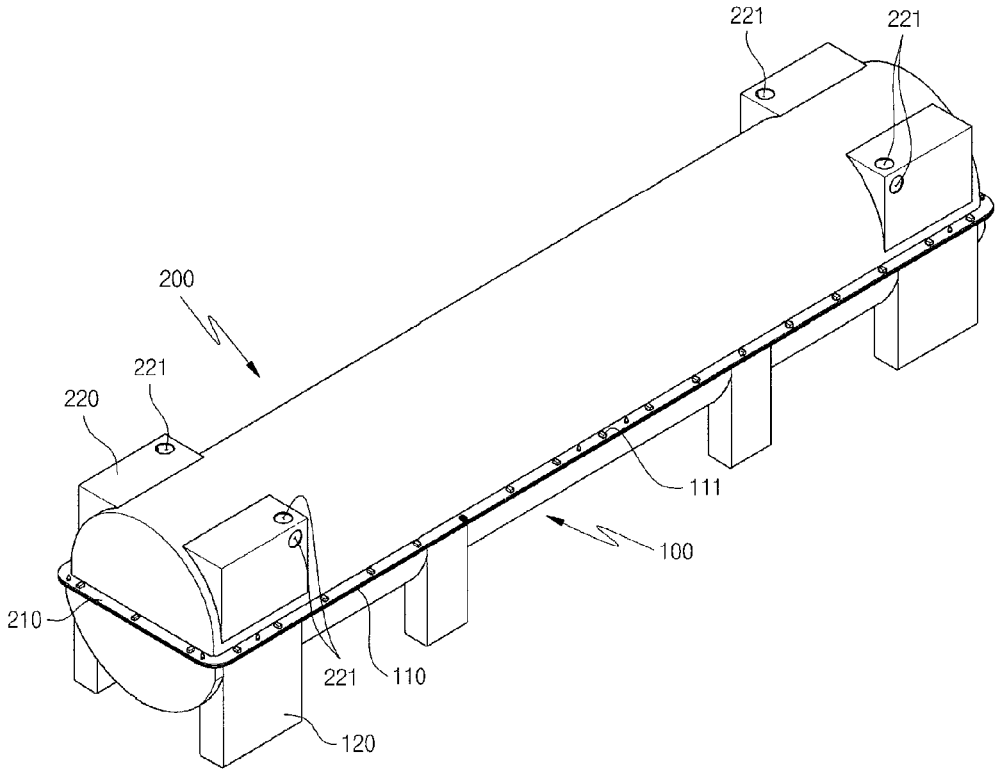
FIG. 3 shows an appearance of a nuclear fuel assembly shipping container according to an exemplary embodiment of the present invention.

FIG. 3 shows an appearance of a nuclear fuel assembly shipping container according to an exemplary embodiment of the present invention. The shipping container of this embodiment is configured so that a cross section of a lower container 100 and an upper container 200 is semi-circular such that at least one nuclear fuel assembly can be held, and are coupled so as to be opposite to each other. Here, each of the lower and upper containers 100 and 200 can be formed of a metal material strong enough to safely transport the nuclear fuel assembly.

In detail, the shipping container of this embodiment is configured so that the upper container 200 is detachably coupled to the lower container 100, the lower and upper containers 100 and 200 are provided with flanges 110 and 210 on outer circumferences thereof, the flange of the lower container 100 has a plurality of assembly protrusions 111 protruding therefrom at regular intervals, and the flange of the upper container 200 is provided with a plurality of assembly holes 211 (see FIG. 4) so as to correspond to and be engaged with the protrusions.

Further, the lower container 100 has a plurality of support legs 120 installed on an outer surface thereof at predetermined intervals so as to support the shipping container. The upper container 200 is provided with loading parts 220 on opposite sides thereof in a lengthwise direction. Each loading part 220 is provided with lift holes 221 such that the upper container 200 can be lifted by, for instance, a crane.

Figure 4:
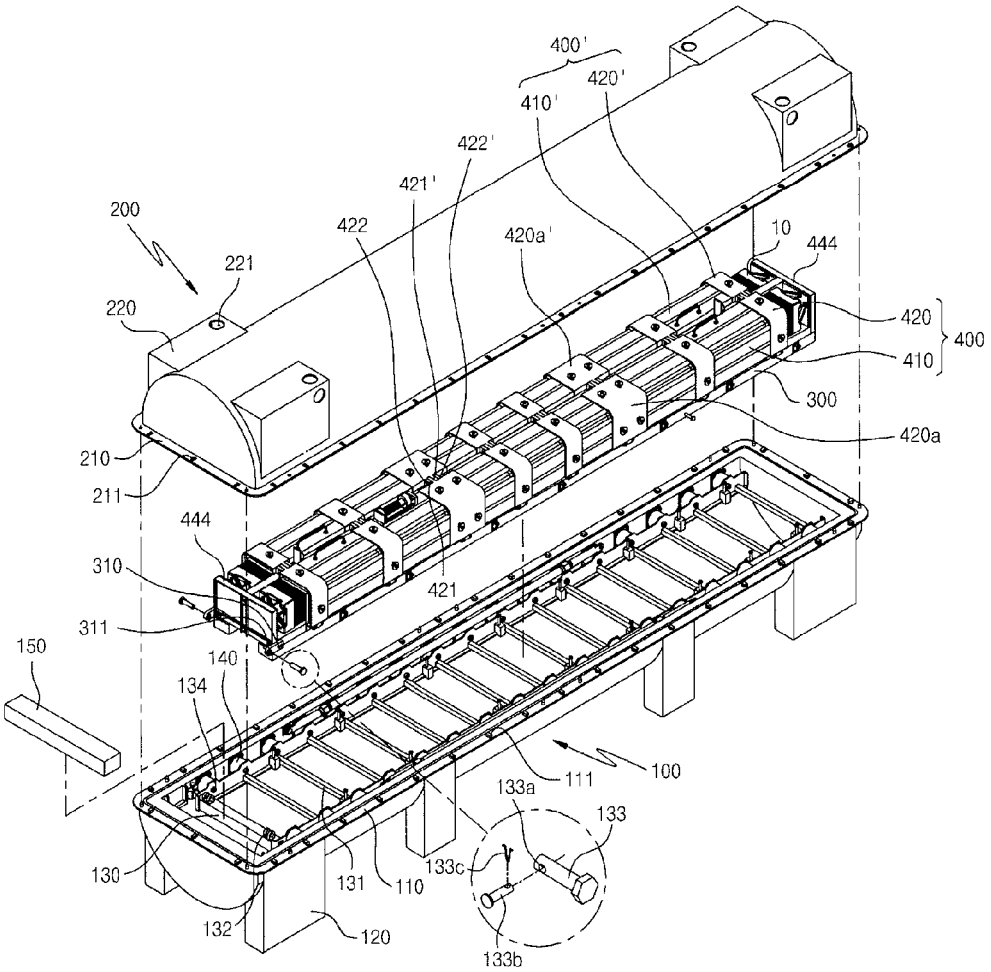
FIG. 4 is an exploded perspective view showing the nuclear fuel assembly shipping container of FIG. 3 according to the exemplary embodiment of the present invention.
Figure 5:
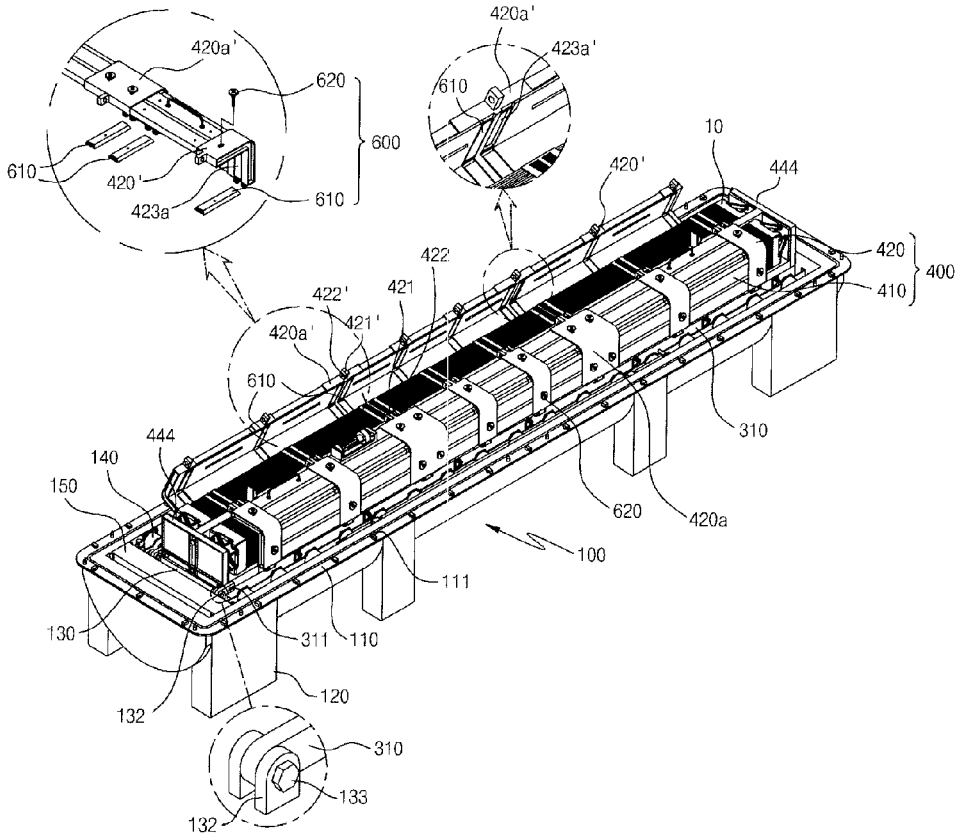
FIG. 5 is a perspective view showing a nuclear fuel assembly shipping container according to an exemplary embodiment of the present invention, wherein an upper container is removed from the nuclear fuel assembly shipping container.
Figure 6:
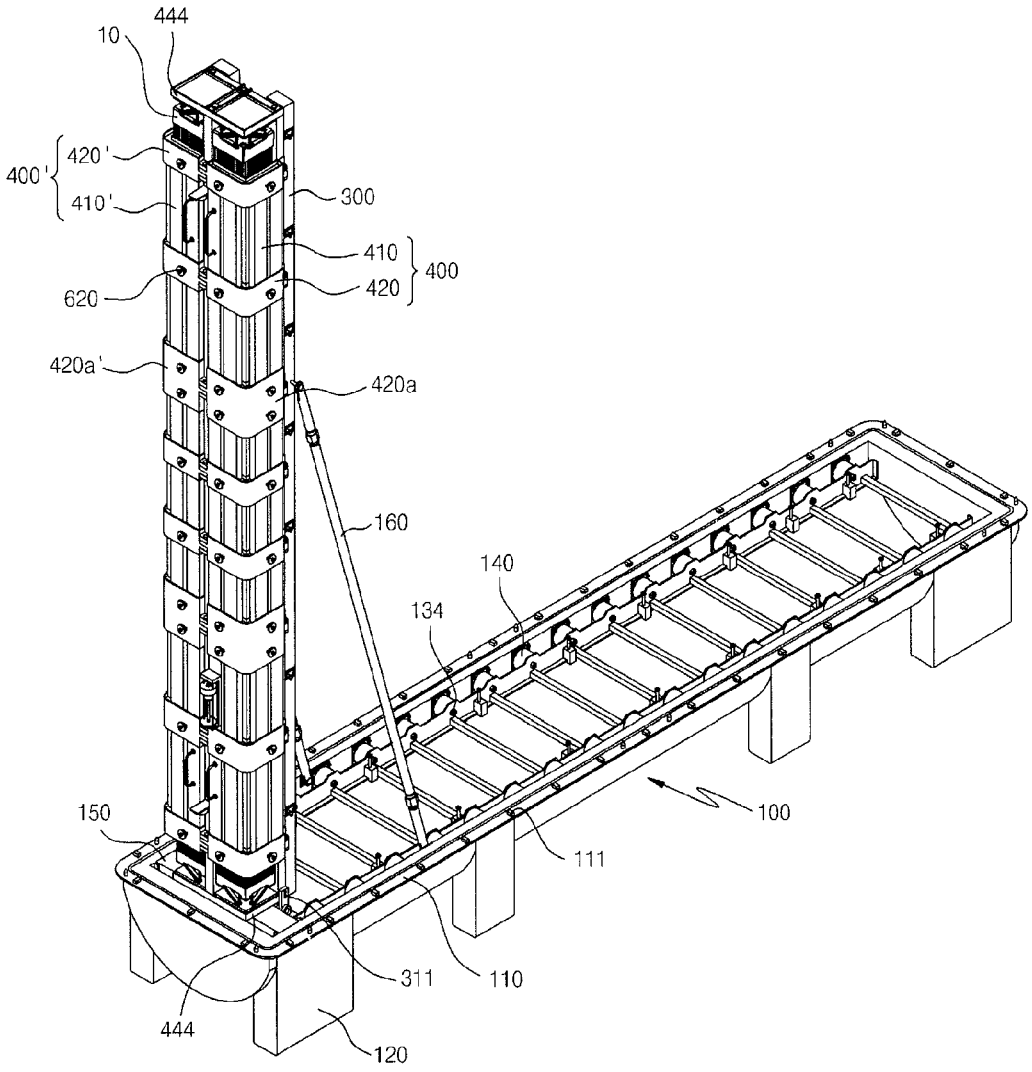
FIG. 6 is a perspective view showing a nuclear fuel assembly shipping container according to an exemplary embodiment of the present invention, wherein a lid frame clamping a nuclear fuel assembly stands erect.

FIG. 4 is an exploded perspective view showing the nuclear fuel assembly shipping container of FIG. 3 according to the exemplary embodiment of the present invention, wherein lower and upper containers 100 and 200 are separated from each other. FIG. 5 is a perspective view showing a nuclear fuel assembly shipping container according to an exemplary embodiment of the present invention, wherein an upper container is removed from the nuclear fuel assembly shipping container. FIG. 6 is a perspective view showing a nuclear fuel assembly shipping container according to an exemplary embodiment of the present invention, wherein a lid frame clamping a nuclear fuel assembly stands erect.

As shown in FIG. 4, a lower container 100 is provided therein with a base frame 300 and a pair of lid frames 400 and 400' so as to be able to stably support at least one nuclear fuel assembly 10. A cradle 130 is installed in the lower container 100 such that the base frame 300 can be placed on the cradle 130. The base frame 300 is placed on the cradle 130 with the nuclear fuel assembly 10 placed on an upper surface of the base frame. The cradle 130 has a plurality of supports 131 installed in a lengthwise direction at predetermined intervals. The cradle 130 is fixed to the lower container 100 by fasteners 134 such as screws. Here, buffers 140 formed of a rubber material are interposed between the lower container 100 and the cradle 130 in order to relieve external shocks that can be applied to the nuclear fuel assembly 10. Each buffer 140 is provided with a fastener hole (not shown) in the center thereof in a lengthwise direction. The fasteners 134 are fastened into the fastener holes through the cradle 130. Thereby, the cradle 130 is fixedly coupled to the lower container 100 so as to be able to absorb shocks.

The lid frame 400 or 400' includes supports 410 or 410' stably surrounding the nuclear fuel assembly 10, narrow clamps 420 or 420' and wide clamps **420*a* or 420*a*' disposed on the supports 410 or 410' at predetermined intervals, and end support plates 444 supporting opposite ends of the nuclear fuel assembly 10. The supports 410 or 410' are separated from each other, and are installed in a lengthwise direction of the nuclear fuel assembly 10**.

Here, the supports 410 or 410' are disposed apart from each other at predetermined intervals, rather than integrally formed in one flat plate shape. Thus, a guide slot is naturally formed between the two adjacent supports.

Each of the narrow clamps 420 or 420' and the wide clamps **420*a* or 420*a*' is rotatably hinged to the base frame 300 at one end thereof. Here, the narrow clamps 420 or 420' and the wide clamps 420*a* or 420*a*' are welded to the supports 410 or 410', which are separated from each other, so as to be perpendicular to the supports 410 or 410', and thus are integrally formed with the supports 410 or 410'** so as to be able to be rotated.

Meanwhile, in this embodiment, the shipping container for transporting two nuclear fuel assemblies 10 at the same time has been described by way of example. As shown in FIG. 5, the lid frames 400 and 400' are rotatably installed on the base frame 300 on opposite long sides of the base frame 300 so as to be opposite to each other. Further, each pair of narrow clamps 420 and 420' or each pair of wide clamps **420*a*** and

420*a*' are configured to be fastened to each other, and are provided with male and female fasteners 421 and 421' on free ends thereof so as to be engaged with each other, respectively. Further, the male and female fasteners 421 and 421' are provided with bolting holes 422 and 422' respectively, so that they can be firmly fixed to each other by a fixing bolt (not shown). Here, the narrow clamps 420 or 420' are arranged so as to correspond to the spacer grids of the nuclear fuel assembly 10, so that they can stably clamp the nuclear fuel assembly.

Figure 1:
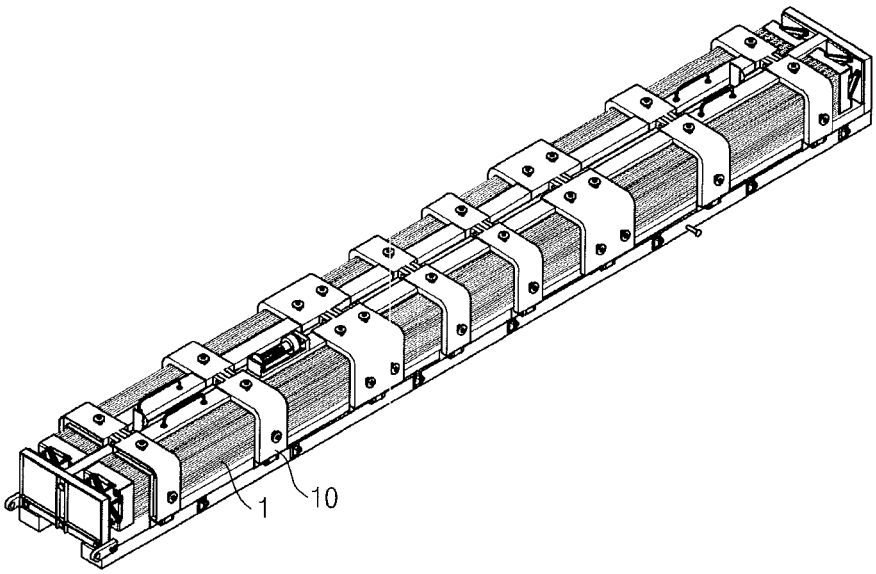
FIG. 1 PRIOR ART
FIG. 1 is a perspective view showing a conventional nuclear fuel assembly shipping container.
Figure 2:
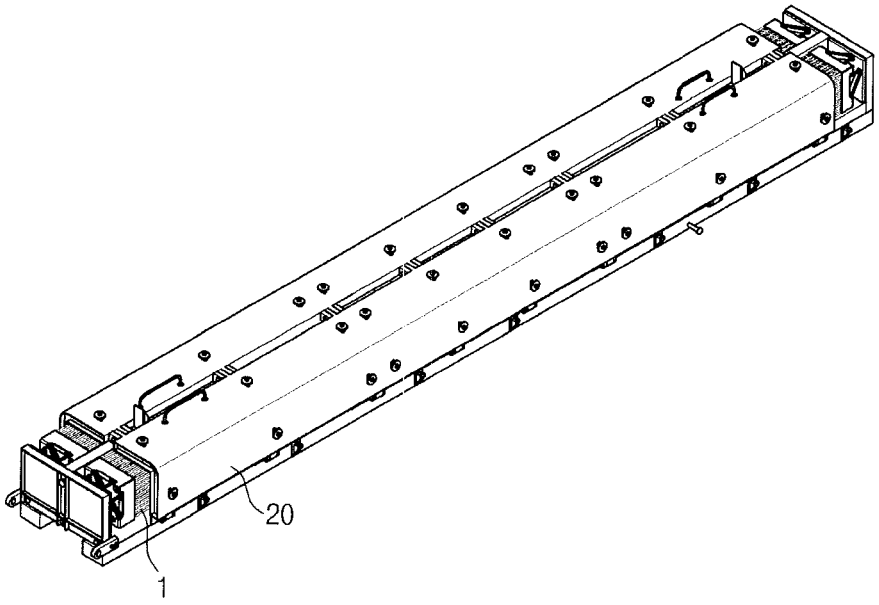
FIG. 2 PRIOR ART
FIG. 2 is a perspective view showing another conventional nuclear fuel assembly shipping container based on technology of AREVA® company of France and NFI® company of Japan.

In this manner, the lid frame 400 or 400' of this embodiment is configured so that the supports 410 or 410', which are separated from each other, and the narrow clamps 420 or 420' and the wide clamps 420*a* or 420*a*', which are coupled to the supports 410 or 410' at predetermined intervals respectively, have a lattice shape. Thus, the lid frames 400 and 400' can be remarkably reduced in weight compared to a conventional lid frame where a pair of clamping frames 20 are formed in a completely closed shape as shown in FIG. 2, and thus make transportation easier. Furthermore, the lid frames 400 and 400' can also reduce the cost of production, which is advantageous from the economical point of view.

Further, each of the narrow clamps 420 or 420' and the wide clamps 420*a* or 420*a*' can be provided with press members 600 for pressing the spacer grids of the nuclear fuel assembly 10 to more stably clamp the nuclear fuel assembly 10

Each press member 600 includes a flat-plate-shaped press plate 610, which is interposed between each of the clamps 420, 420', 420*a* and 420*a*' and each spacer grid, and an adjustment screw 620, which passes through each of the clamps 420, 420', 420*a* and 420*a*' to be coupled to the press plate 610. Thus, pressure is applied to or released from the press plate 610 using the adjustment screw 620, so that the nuclear fuel assembly 10 can be firmly clamped to the lid frame 400 or 400'.

A first press plate holding recess 423 or 423', which holds the flat-plate-shaped press plate 610, is formed inside the narrow clamp 420 or 420', and second press plate holding recesses 423*a* or 423*a*', which hold the flat-plate-shaped press plates 610, are formed inside the wide clamp 420*a* or 420*a'*.

Here, the second press plate holding recesses 423*a* or 423*a*' are provided inside the wide clamp 420*a* or 420*a*' so as to correspond to dimensions (width and length) of the wide clamp 420*a* or 420*a*' and to have a width of the first press plate holding recess 423 or 423'.

These wide clamps 420*a* or 420*a*' are formed so as to have a width that covers a change in position of each spacer grid of the nuclear fuel assembly to be transported. Thereby, in different types of nuclear fuel assemblies between which the position of each spacer grid is different, the spacer grid located at a different position can be fixedly pressed using the press plate 610. Accordingly, the lid frame 400 or 400' can clamp and transport the different types of nuclear fuel assemblies without requiring a separate change in structure.

In the shipping container of the present invention constructed as described above, after the nuclear fuel assembly has been transported to a nuclear power plant, the nuclear fuel assembly must be erected from the shipping container. Thereby, it is easy to store the nuclear fuel assembly in a temporary storehouse.

Thus, as shown in FIG. 6, the nuclear fuel assembly is erected from the shipping container by lifting one end of the nuclear fuel assembly in an upward direction using, for instance, a nuclear fuel assembly handling crane.

Here, as shown in FIG. 5, the cradle 130 is provided with hinge couplers 132 at one end thereof, and the base frame 300 is provided with hinge pieces 310 that correspond to the hinge couplers 132. The hinge couplers 132 and the hinge pieces 310 are provided with hinge holes 311 so as to be aligned with each other. A hinge bolt 133 (FIGS. 4 and 5) is fitted into the hinge holes 311. When one end of the nuclear fuel assembly is lifted, the nuclear fuel assembly can be more stably pivoted because the other end of the nuclear fuel assembly is coupled to the cradle 130 by the hinge bolt 133 that functions as a rotational shaft. As shown in FIG. 4, the hinge bolt 133 is provided with a fixing hole 133*a* in one end thereof. After the hinge bolt 133 is inserted into the hinge holes 311 formed in the hinge coupler 132 and the hinge piece 310, it is rotatably fixed by a fixing rod 133*b* and a fixing pin 133*c* fixing the fixing rod 133*b*. To fix the hinge bolt 133, all fixing means for rotatably coupling the hinge bolt 133 to the hinge coupler 132 and the hinge piece 310 can be used in addition to the fixing rod 133*b* and the fixing pin 133*c*.

In this manner, when the nuclear fuel assembly is erected by pivoting one end of the nuclear fuel assembly, the nuclear fuel assembly can be erected by a nuclear fuel assembly handling crane having a relatively small capacity, because the lid frame 400 or 400' of this embodiment is formed in a lattice shape and thus its weight is sufficiently reduced compared to an existing closed-type clamping frame.

Meanwhile, the lower container 100 of this embodiment is provided with a bedplate 150 at one end thereof which can support a load of the nuclear fuel assembly when the nuclear fuel assembly stands erect. A support rod 160 can be hinged to the lower container 100 and the base frame 300 at opposite ends thereof, respectively, so as to be able to sufficiently support the nuclear fuel assembly.

Although exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A shipping container for nuclear fuel assembly, comprising:

a base frame;

a lid frame including a plurality of clamps separated from each other and rotatably hinged to the base frame, and a plurality of supports installed apart from each other and coupled perpendicularly to the plurality of clamps.

2. A shipping container for nuclear fuel assembly, the shipping container comprising:

a lower container including a cradle;

an upper container detachably coupled to the lower container;

a base frame coupled to the cradle; and a pair of lid frames installed on opposite long sides of the base frame, wherein each of the lid frames includes, a plurality of clamps separated from each other and rotatably hinged to the base frame; and a plurality of supports installed apart from each other and coupled perpendicularly to the plurality of clamps.

3. The shipping container according to claim 2, further comprising buffers interposed between the lower container and the cradle in order to absorb shocks.

4. The shipping container according to claim 2, further comprising:

hinge couplers located at one end of the cradle;

hinge pieces located on the base frame so as to correspond to the hinge couplers; and hinge bolts, each of the hinge bolts being configured to couple a corresponding hinge coupler and hinge piece.

5. The shipping container according to claim 2, further comprising press members installed on inner surfaces of the plurality of clamps.

6. The shipping container according to claim 5, wherein each of the press members includes, at least one press plate facing an inner surface of a corresponding clamp, and an adjustment screw coupling the at least one press plate to the corresponding clamp, wherein the plurality of clamps includes a first clamp and a second clamp, and the first clamp has a narrower width than that of the second clamp.

7. The shipping container according to claim 6, further comprising:

a first press plate holding recess located in an inner surface of the first clamp and configured to hold the at least one press plate; and at least one second press plate holding recess located in an inner surface of the second clamp and configured to hold the at least one press plate.

* * * * *